US008570309B2

(12) United States Patent
Jeong

(10) Patent No.: US 8,570,309 B2
(45) Date of Patent: Oct. 29, 2013

(54) BUFFER AND ORGANIC LIGHT EMITTING DISPLAY USING THE SAME

(75) Inventor: Jin-Tae Jeong, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 1061 days.

(21) Appl. No.: 12/418,293

(22) Filed: Apr. 3, 2009

(65) Prior Publication Data

US 2009/0267933 A1 Oct. 29, 2009

(30) Foreign Application Priority Data

Apr. 25, 2008 (KR) ..... 10-2008-0038627

(51) Int. Cl.
*G09G 5/00* (2006.01)
*G09G 3/30* (2006.01)

(52) U.S. Cl.
USPC ..... 345/204; 345/76

(58) Field of Classification Search
USPC ..... 345/76–100, 204, 211–213; 377/75–77, 377/81
See application file for complete search history.

(56) References Cited

U.S. PATENT DOCUMENTS

| | | | | |
|---|---|---|---|---|
| 5,949,271 | A * | 9/1999 | Fujikura | 327/390 |
| 6,392,627 | B1 * | 5/2002 | Maekawa | 345/98 |
| 2004/0164978 | A1 * | 8/2004 | Shin et al. | 345/211 |
| 2006/0022909 | A1 * | 2/2006 | Kwak et al. | 345/76 |
| 2006/0271757 | A1 * | 11/2006 | Kim | 711/167 |
| 2008/0036385 | A1 * | 2/2008 | Maede et al. | 315/169.3 |

FOREIGN PATENT DOCUMENTS

| | | |
|---|---|---|
| JP | 11-242204 | 9/1999 |
| JP | 2005-037842 A | 2/2005 |
| KR | 10-2004-0006337 | 1/2004 |
| KR | 10-2004-0076087 | 8/2004 |
| KR | 10-2006-0053199 | 5/2006 |
| KR | 10-0629576 B1 | 9/2006 |

OTHER PUBLICATIONS

Korean Office action dated Aug. 24, 2009, for priority Korean application 10-2008-0038627, as well as KR 10-2004-0076087 dated Apr. 3, 2009, and KR 10-2006-0053199 dated Sep. 15, 2009.
Korean Office action dated Jun. 19, 2009, for priority Korean application 10-2008-0038627, as well as KR 10-2004-0076087 dated Apr. 3, 2009.

* cited by examiner

*Primary Examiner* — Rodney Amadiz
(74) *Attorney, Agent, or Firm* — Christie, Parker & Hale, LLP

(57) ABSTRACT

A buffer and an organic light emitting display using the same that reduces (or prevents) a signal of the organic light emitting display from being delayed by improving an output signal of the buffer. The buffer includes an input unit between a first power source and a second power source having a voltage lower than the first power source, and for receiving an input signal to output a first signal; a first inverter between the first and second power sources, and for receiving the first signal and the input signal to output a second signal obtained by inverting the first signal; a second inverter between the first and second power sources, and for receiving the second signal and the first signal to output a third signal obtained by inverting the second signal; and an output unit coupled between the first power source and a third power source having a voltage lower than the second power source, and for receiving the third signal and the second signal to output an output signal obtained by inverting the third signal.

20 Claims, 4 Drawing Sheets

BUFFER AND ORGANIC LIGHT EMITTING DISPLAY USING THE SAME

CROSS-REFERENCE TO RELATED APPLICATIONS

This application claims priority to and the benefit of Korean Patent Application No. 10-2008-0038627, filed on Apr. 25, 2008, in the Korean Intellectual Property Office, the entire content of which is incorporated herein by reference.

BACKGROUND OF THE INVENTION

1. Field of the Invention

The present invention relates to a buffer and an organic light emitting display using the same.

2. Description of Related Art

Recently, various types of flat panel display devices have been developed. These flat panel display devices are generally lighter in weight and smaller in volume than comparable cathode ray tube displays. The flat panel display devices include a liquid crystal display, a field emission display, a plasma display panel, an organic light emitting display, and the like.

Among these flat panel displays, the organic light emitting display displays images using an organic light emitting diode (OLED) that emits light through the recombination of electrons and holes.

An OLED used in an organic light emitting display includes an anode electrode, a cathode electrode, and a light emitting layer formed between the anode and cathode electrodes. In the OLED, if current flows in a direction from the anode electrode to the cathode electrode, light is emitted from the light emitting layer.

Such an organic light emitting display displays images using the characteristics of the OLED. The organic light emitting display includes a plurality of pixels each having a thin film transistor (TFT) and an OLED. An amount of current that flows into the OLED is controlled by the TFT to express luminance.

Currently, the size of an organic light emitting display is becoming larger. In order to decrease manufacturing costs of organic light emitting displays (that may be relatively large), a plurality of flat panel displays are formed on a large-sized bare glass substrate and then the substrate is cut, thereby completing respective organic light emitting displays.

After pixels are formed on the bare glass substrate, a test such as a lighting test or the like is carried out on the bare glass substrate so as to inspect whether each of the pixels operates properly. Since a large number of pixels are formed on the bare glass substrate, a large number of resistors and capacitors are also formed on the bare glass substrate. Therefore, a signal delay may occur due to the resistors and capacitors.

Such a signal delay may cause a driving failure of the organic light emitting display.

SUMMARY OF THE INVENTION

Accordingly, aspects of embodiments of the present invention are directed toward a buffer and an organic light emitting display using the same that reduces (or prevents) occurrence of a signal delay of the organic light emitting display by improving an output signal of the buffer.

An embodiment of the present invention provides a buffer that includes: an input unit between a first power source and a second power source having a voltage lower than the first power source, and for receiving an input signal to output a first signal; a first inverter between the first and second power sources, and for receiving the first signal and the input signal to output a second signal obtained by inverting the first signal; a second inverter between the first and second power sources, and for receiving the second signal and the first signal to output a third signal obtained by inverting the second signal; and an output unit coupled between the first power source and a third power source having a voltage lower than the second power source, and for receiving the third signal and the second signal to output an output signal obtained by inverting the third signal.

Another embodiment of the present invention provides an organic light emitting display that includes: a pixel unit having a plurality of pixels arranged therein; and a buffer for amplifying and providing a test signal to the pixel unit to test the pixel unit. The buffer includes: an input unit between a first power source and a second power source having a voltage lower than the first power source, and for receiving an input signal to output a first signal; a first inverter between the first and second power sources, and for receiving the first signal and the input signal to output a second signal obtained by inverting the first signal; a second inverter between the first and second power sources, and for receiving the second signal and the first signal to output a third signal obtained by inverting the second signal; and an output unit coupled between the first power source and a third power source having a voltage lower than the second power source, and for receiving the third signal and the second signal to output an output signal obtained by inverting the third signal.

In the buffer and/or the organic light emitting display according to embodiments of the present invention, output characteristics of a signal outputted from the buffer are improved, so that a signal delay generated by resistor and capacitor components can be reduced.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION OF EMBODIMENTS

Figure 1:
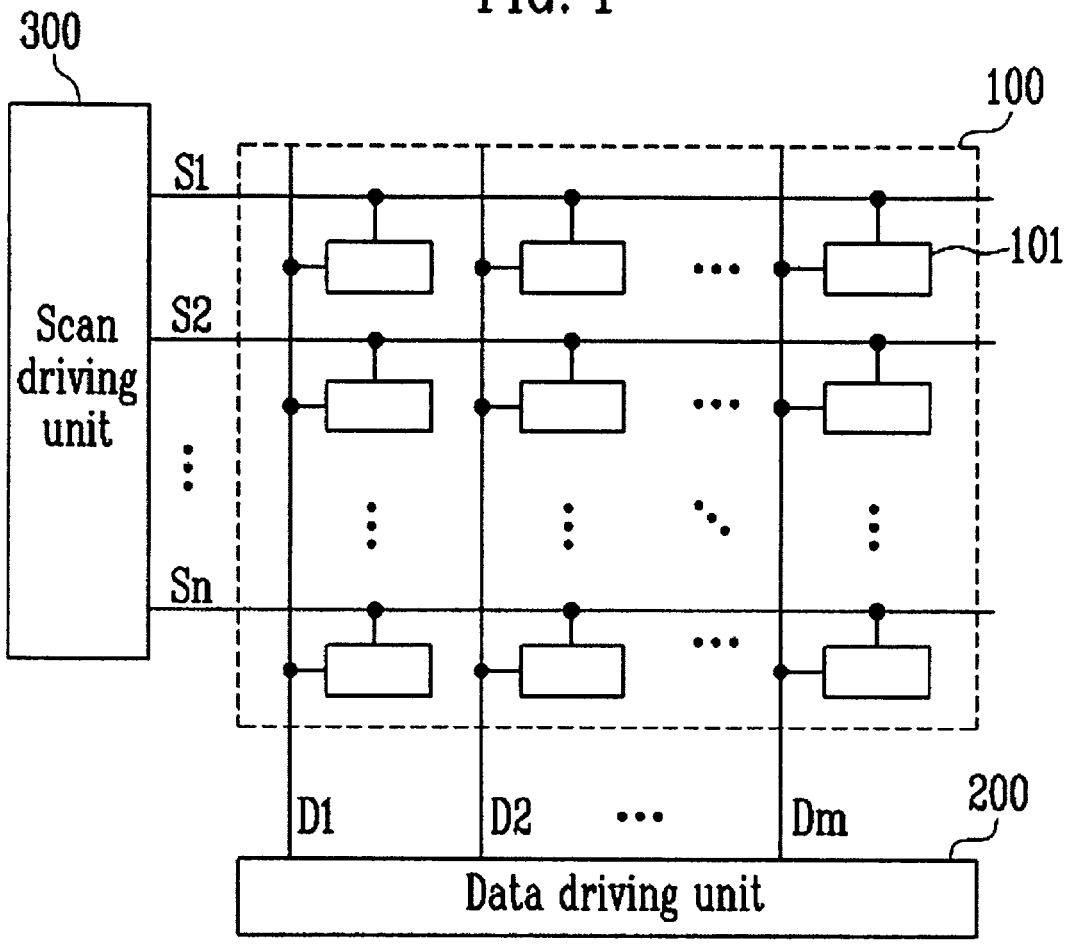
FIG. 1 schematically shows an organic light emitting display according to an embodiment of the present invention.

Hereinafter, certain exemplary embodiments according to the present invention will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the invention are omitted for clarity. Also, like reference numerals refer to like elements throughout.

FIG. 1 schematically shows an organic light emitting display according to an embodiment of the present invention. Referring to FIG. 1, the organic light emitting display includes a pixel unit (or display region) 100, a data driving unit 200 and a scan driving unit 300.

A plurality of pixels 101 are arranged in the pixel unit 100, each of which includes an organic light emitting diode. In the pixel unit 100, n scan lines S1, S2, . . . , Sn−1, and Sn for transferring scan signals are arranged in a row direction, and m data lines D1, D2, . . . , Dm−1 and Dm for transferring data signals are arranged in a column direction.

The data driving unit 200 generates a data signal using an image signal (R, G and B data) and a gamma correction signal. The data driving unit 200 is coupled to the data lines D1, D2, . . . , Dm−1 and Dm of the pixel unit 100 and applies the generated data signal to the pixel unit 100 through the data lines D1, D2, . . . , Dm−1 and Dm.

The scan driving unit 300 generates scan signals and is coupled to the scan lines S1, S2, . . . , Sn−1 and Sn to transfer a scan signal to a specific row of the pixel unit 100. The data signal generated from the data driving unit 200 is transferred to the pixels 101 to which the scan signal is transferred, thereby generating a driving current. The generated driving current flows into the organic light emitting diode.

Figure 2:
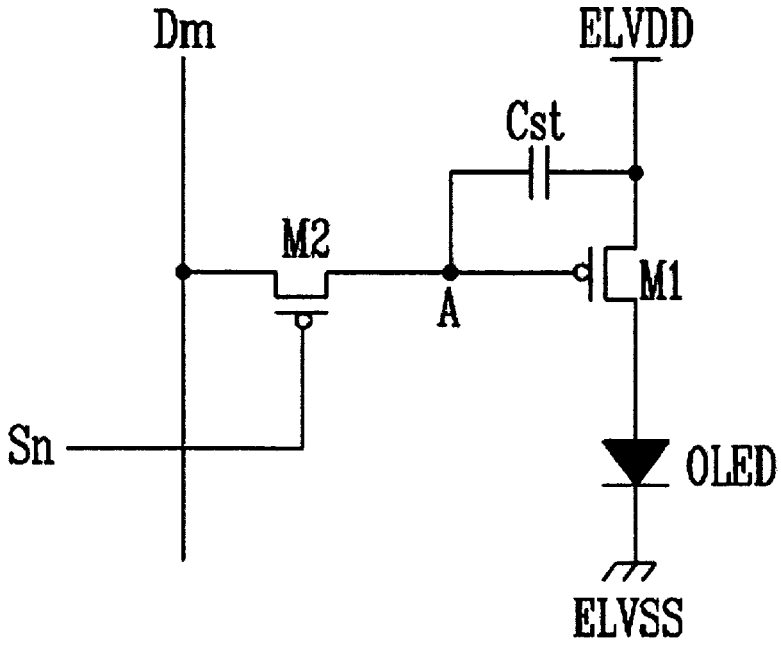
FIG. 2 is a circuit diagram schematically showing a pixel employed in the organic light emitting display shown in FIG. 1.

FIG. 2 is a circuit diagram schematically showing a pixel employed in the organic light emitting display shown in FIG. 1. Referring to FIG. 2, the pixel includes a first transistor M1, a second transistor M2, a capacitor Cst and an organic light emitting diode OLED.

The first transistor M1 includes a source coupled to a pixel power source ELVDD, a drain coupled to an anode electrode of the organic light emitting diode OLED, and a gate coupled to a first node A. Thus, the first transistor M1 determines an amount of current that flows in a direction from the source to the drain of the first transistor M1 corresponding to a voltage at the first node A.

The second transistor M2 includes a source coupled to a data line Dm, a drain coupled to the first node A, and a gate coupled to a scan line Sn. Thus, the second transistor M2 allows a data signal supplied to the data line Dm to be transferred to the first node A corresponding to a scan signal transferred through the scan line Sn.

The capacitor Cst includes a first electrode coupled to the pixel power source ELVDD and a second electrode coupled to the first node A. Thus, the capacitor Cst allows the voltage at the first node A to be maintained, so that an amount of current that flows in the direction from the source to the drain of the first transistor M1 is kept constant for a certain (or predetermined) time period.

The organic light emitting diode OLED includes an anode electrode, a cathode electrode and a light emitting layer formed between the anode and cathode electrodes. In the organic light emitting diode OLED, the anode electrode is coupled to the drain of the first transistor M1, and the cathode electrode is coupled to a ground power source ELVSS. Therefore, if current flows in a direction from the anode electrode to the cathode electrode of the organic light emitting diode OLED, light is emitted.

Figure 3:
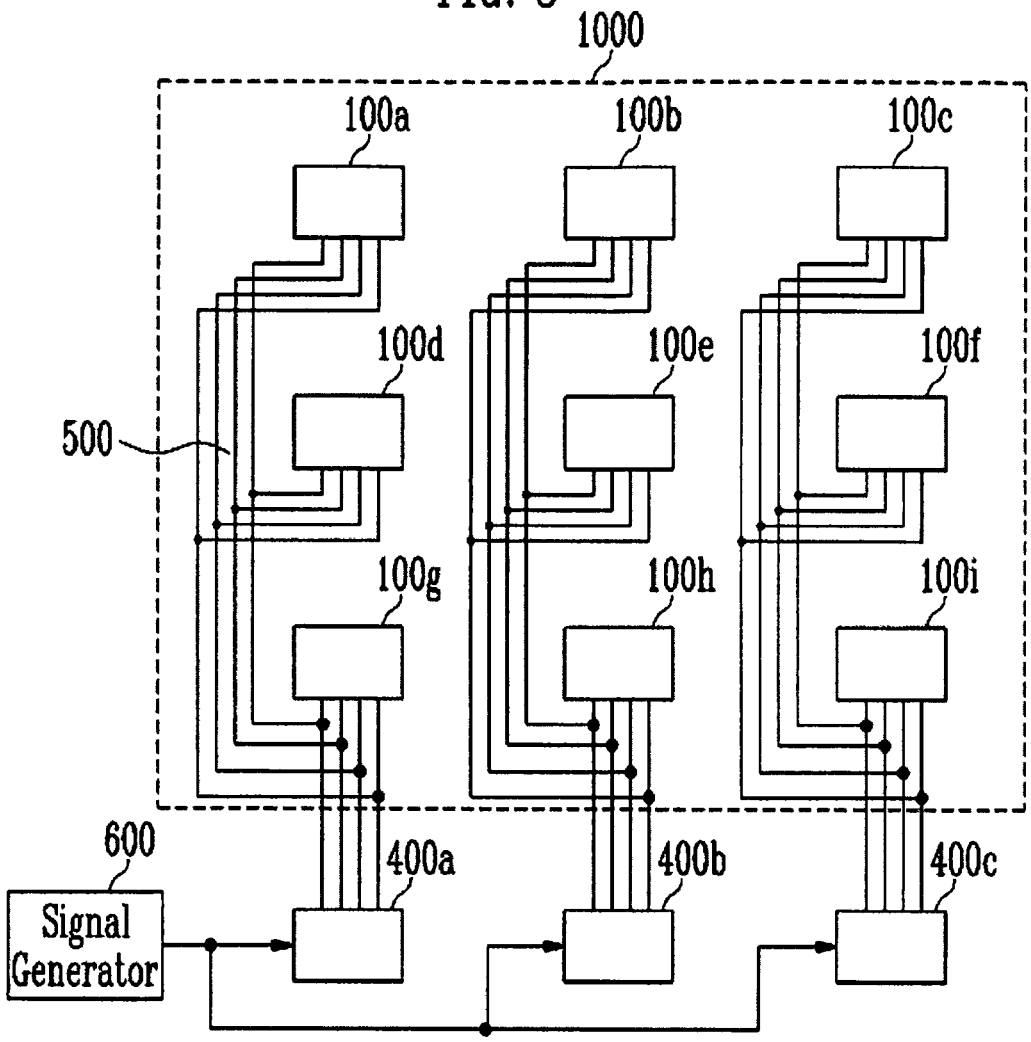
FIG. 3 schematically shows that a plurality of organic light emitting displays shown in FIG. 1 are formed on a bare glass substrate.

FIG. 3 schematically shows a plurality of organic light emitting displays shown in FIG. 1 are formed on a bare glass substrate. Referring to FIG. 3, pixel units 100*a*, 100*b*, 100*c*, 100*d*, 100*e*, 100*f*, 100*g*, 100*h*, and 100*i* of the plurality of the organic light emitting displays are formed on a bare glass substrate 1000. Test wires 500 to transfer signals to the plurality of pixel units 100*a*, 100*b*, 100*c*, 100*d*, 100*e*, 100*f*, 100*g*, 100*h*, and 100*i* are formed on the bare glass substrate 1000.

A signal generator 600 and a plurality of buffers 400*a*, 400*b* and 400*c* are coupled to the bare glass substrate 1000 formed as described above. Here, the signal generator 600 applies a signal to the respective pixel units 100*a*, 100*b*, 100*c*, 100*d*, 100*e*, 100*f*, 100*g*, 100*h*, and 100*i*. The plurality of buffers 400*a*, 400*b* and 400*c* receive the signal generated from the signal generator 600 and improve signal characteristics of the signal for transferring to the respective pixel units 100*a*, 100*b*, 100*c*, 100*d*, 100*e*, 100*f*, 100*g*, 100*h*, and 100*i* through the test wires 500.

The respective buffers 400*a*, 400*b* and 400*c* transfer a signal to the pixel units 100*a*, 100*b*, 100*c*, 100*d*, 100*e*, 100*f*, 100*g*, 100*h*, and 100*i* each having a plurality of pixels through the test wires 500. Here, the signal transferred through the test wires 500 may be delayed by a resistor and a capacitor of a pixel, and thus there is a need for the buffers 400*a*, 400*b* and 400*c* with improved signal characteristics.

After the pixel units 100*a*, 100*b*, 100*c*, 100*d*, 100*e*, 100*f*, 100*g*, 100*h*, and 100*i* are tested by transferring a signal through the buffers 400*a*, 400*b* and 400*c*, the bare glass substrate 1000 is cut so that the respective pixel units 100*a*, 100*b*, 100*c*, 100*d*, 100*e*, 100*f*, 100*g*, 100*h*, and 100*i* are separated. In the process of cutting the bare glass substrate 1000, the test wires 500 and the buffers 400*a*, 400*b* and 400*c* are electrically disconnected from the pixel units 100*a*, 101*b*, 100*c*, 100*d*, 100*e*, 100*f*, 100*g*, 100*h*, and 100*i*.

Figure 4:
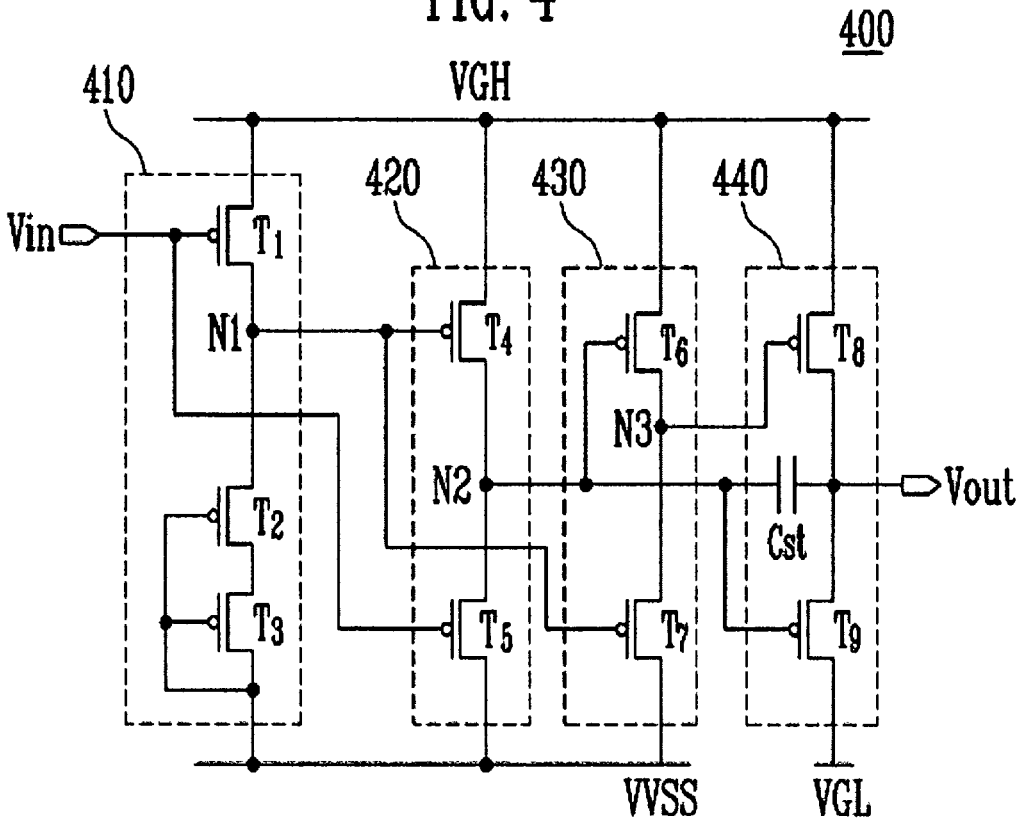
FIG. 4 is a circuit diagram schematically showing a buffer shown in FIG. 3.

FIG. 4 is a circuit diagram schematically showing a buffer shown in FIG. 3. Referring to FIG. 4, the buffer 400 includes an input unit (or input circuit or input) 410, a first inverter 420, a second inverter 430 and an output unit 440.

Here, the input unit 410 includes a first transistor T1, a second transistor T2 and a third transistor T3. The first inverter 420 includes a fourth transistor T4 and a fifth transistor T5, and the second inverter 430 includes a sixth transistor T6 and a seventh transistor T7. The output unit 440 includes an eighth transistor T8, a ninth transistor T9 and a capacitor Cst.

In the input unit 410, the first transistor T1 includes a source coupled to a first power source VGH, a drain coupled to a first node N1, and a gate coupled to an input terminal Vin. The second transistor T2 includes a source coupled to the first node N1, a drain coupled to a source of the third transistor T3, and a gate coupled to a second power source VVSS. The third transistor T3 includes a source coupled to the drain of the second transistor T2, and a drain and a gate, coupled to the second power source VVSS.

In the first inverter 420, the fourth transistor T4 includes a source coupled to the first power source VGH, a drain coupled to a second node N2, and a gate coupled to the first node N1. The fifth transistor T5 includes a source coupled to the second node N2, a drain coupled to the second power source VVSS, and a gate coupled to the input terminal Vin.

In the second inverter 430, the sixth transistor T6 includes a source coupled to the first power source VGH, a drain coupled to a third node N3, and a gate coupled to the second node N2. The seventh transistor T7 includes a source coupled to the third node N3, a drain coupled to the second power source VVSS, and a gate coupled to the first node N1.

In the output unit 440, the eighth transistor T8 includes a source coupled to the first power source VGH, a drain coupled to an output terminal Vout, and a gate coupled to the third node N3. The ninth transistor T9 includes a source coupled to the output terminal Vout, a drain coupled to a third power source VGL, and a gate coupled to the second node N2. The capacitor Cst includes a first electrode coupled to the second node N2 and a second electrode coupled to the output terminal Vout.

Here, the second power source VVSS has a voltage lower than the first power source VGH, and the third power source VGL has a voltage lower than the second power source VVSS.

Referring still to FIG. 4, the operation of the buffer 400 will be described in more detail. If an input signal of a high level is inputted through the input terminal Vin, the first and fifth transistors T1 and T5 are turned off. The same voltage is applied to the gates of the second and third transistors T2 and T3 by the second power source VVSS. Since the second power source VVSS has a low voltage, the second and third transistors T2 and T3 are turned on, and therefore, current flows in a direction from the first node N1 to the second power source VVSS. Accordingly, the first power source VGH is cut off by the first transistor T1, and current flows in the direction from the first node N1 to the second power source VVSS, so that the first node N1 has a voltage of a low level.

If the voltage of the first node N1 becomes a voltage of a low level, the fourth and seventh transistors T4 and T7 are turned on. At this time, since the fifth transistor T5 is in an off-state, the voltage of the second node N2 becomes the voltage of the first power source VGH (i.e., a voltage of a high level).

If the voltage of the second node N2 becomes a voltage of a high level, the sixth and ninth transistors T6 and T9 are turned off. At this time, since the sixth transistor T6 is in an off-state and the seventh transistor T7 is in an on-state, the voltage of the third node N3 has the voltage of the second power source VVSS (i.e., a voltage of a low level).

By contrast, if the voltage of the third node N3 is in a low state, the eighth transistor T8 is turned on. At this time, since the eighth transistor T8 is in an on-state and the ninth transistor T9 is in an off-state, a high voltage of the first power source VGH is outputted to the output terminal Vout.

If a signal of a low level is inputted through the input terminal Vin, the first and fifth transistors T1 and T5 are turned on. At this time, the gates of the second and third transistors T2 and T3 are coupled to the second power source VVSS to maintain an on-state. Thus, the first, second and third transistors T1, T2 and T3 are in an on-state, so that current flows in a direction from the first power source VGH to the second power source VVSS.

However, a voltage corresponding to the difference between voltages of the first and second power sources VGH and VVSS is distributed at the first node N1 by the on-resistance of the first transistor T1 and the on-resistance of the second and third transistors T2 and T3. Assuming that the on-resistances of the first, second and third transistors T1, T2 and T3 are the same, the voltage applied to the second and third transistors T2 and T3 is higher than that applied to the first transistor T1 due to the voltage distribution. Therefore, the voltage of the first node N1 is lower than that of the first power source VGH, but the voltage of the first node N1 is still in a high state.

That is, the second and third transistors T2 and T3 are coupled to each other so that a voltage between the first and second power sources VGH and VVSS is distributed at the first node N1, and thus the voltage of the first node N1 is in a high state. In this embodiment, two transistors, i.e., the second and third transistors T2 and T3 are coupled between the first node N1 and the second power source VVSS. However, the present invention is not limited thereto. That is, two or more transistors may be coupled between the first node N1 and the second power source VVSS.

If the voltage of the first node N1 is in a high state, the fourth and seventh transistors T4 and T7 are in an off-state. At this time, since the fifth transistor T5 is in an on-state, the voltage of the second node N2 is in a low state.

If the voltage of the second node N2 is in a low state, the sixth and ninth transistors T6 and T9 are in an on-state. At this time, since the seventh transistor T7 is in an off-state, the voltage of the third node N3 is in a high state.

If the voltage of the third node N3 is in a high state, the eighth transistor T8 is in an off-state. Since the ninth transistor T9 is in an on-state, the voltage of the third power source VGL is provided to the output terminal Vout to be in a low state. At this time, since the ninth transistor T9 is in an on-state, the voltage of the output terminal Vout is lowered. If the voltage of the output terminal Vout at the source of the ninth transistor T9 is lowered down to a threshold voltage, the ninth transistor T9 is in an off-state, so that the voltage of the output terminal Vout is not lowered any more. In order to solve such a problem, the first electrode of the capacitor Cst is coupled to the gate of the ninth transistor T9, and the second electrode of the capacitor Cst is coupled to the output terminal Vout. If the voltage of the output terminal Vout is lowered, the voltage of the first electrode of the capacitor Cst is also lowered. Therefore, the voltage of the gate of the ninth transistor T9 is lower than the threshold voltage so as not to be in an off-state. Accordingly, the voltage of the output terminal Vout can be further lowered, so that signal characteristics are improved.

In accordance with the aforementioned operation of the buffer 400, if a signal of a high level is inputted through the input terminal Vin, a voltage of a high level is outputted through the output terminal Vout. If a signal of a low level is inputted through the input terminal Vin, a voltage of a low level is outputted through the output terminal Vout.

In addition, the voltage of the third power source VGL is lower than that of the second power source VVSS, so that output characteristics are improved by increasing the turned-on voltage of the ninth transistor T9. Accordingly, a signal delay generated by resistor and capacitor components of a pixel can be reduced.

In the case that a low voltage equal to the voltage of the third power source VGL is used as the voltage of the second power source VVSS, an amount of current that flows through the first, second and third transistors T1, T2 and T3 is increased, and therefore power consumption is increased. As such, according to an embodiment of the present invention, to reduce (or prevent) the amount of current from being increased, the difference between voltages of the first and second power sources VGH and VVSS is implemented to be small. Also, the voltage of the third power source VGL is lower than that of the second power source VVSS and is coupled to the drain of the ninth transistor T9. Accordingly, power consumption is not increased, and signal characteristics are improved.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A buffer comprising:

an input unit between a first power source and a second power source having a voltage lower than the first power source, and for receiving an input signal to output a first signal;

a first inverter between the first and second power sources, and for receiving the first signal and the input signal to output a second signal obtained by inverting the first signal;

a second inverter between the first and second power sources, and for receiving the second signal and the first signal to output a third signal obtained by inverting the second signal; and an output unit coupled between the first power source and a third power source having a voltage lower than the second power source, and for receiving the third signal and the second signal to output an output signal obtained by inverting the third signal, wherein the input unit comprises first, second and third transistors coupled in series between the first and second power sources, the third transistor comprising a gate directly electrically connected to the second power source.

2. The buffer as claimed in claim 1, wherein:

the first transistor comprises a source coupled to the first power source, a drain coupled to a first node, and a gate coupled to an input terminal for receiving the input signal;

the second transistor comprises a source coupled to the first node, a drain coupled to a source of the third transistor, and a gate coupled to the second power source; and the third transistor comprises the source coupled to the drain of the second transistor and a drain coupled to the second power source.

3. The buffer as claimed in claim 2, wherein the first inverter comprises:

a fourth transistor including a source coupled to the first power source, a drain coupled to a second node, and a gate for receiving the first signal; and a fifth transistor including a source coupled to the second node, a drain coupled to the second power source, and a gate for receiving the input signal.

4. The buffer as claimed in claim 3, wherein the second inverter comprises:

a sixth transistor including a source coupled to the first power source, a drain coupled to a third node, and a gate for receiving the second signal; and a seventh transistor including a source coupled to the third node, a drain coupled to the second power source, and a gate for receiving the first signal.

5. The buffer as claimed in claim 4, wherein the output unit comprises:

an eighth transistor including a source coupled to the first power source, a drain coupled to an output terminal for outputting the output signal, and a gate for receiving the third signal; and a ninth transistor including a source coupled to the output terminal, a drain coupled to the third power source, and a gate for receiving the second signal.

6. The buffer as claimed in claim 5, further comprising a capacitor coupled between the output terminal and the gate of the ninth transistor.

7. The buffer as claimed in claim 1, wherein the first inverter comprises:

a first transistor including a source coupled to the first power source, a drain coupled to a node, and a gate for receiving the first signal; and a second transistor including a source coupled to the node, a drain coupled to the second power source, and a gate for receiving the input signal.

8. The buffer as claimed in claim 1, wherein the second inverter comprises:

a first transistor including a source coupled to the first power source, a drain coupled to a node, and a gate for receiving the second signal; and a second transistor including a source coupled to the node, a drain coupled to the second power source, and a gate for receiving the first signal.

9. The buffer as claimed in claim 1, wherein the output unit comprises:

a first transistor including a source coupled to the first power source, a drain coupled to an output terminal for outputting the output signal, and a gate for receiving the third signal; and a second transistor including a source coupled to the output terminal, a drain coupled to the third power source, and a gate for receiving the second signal.

10. The buffer as claimed in claim 9, further comprising a capacitor coupled between the output terminal and the gate of the second transistor.

11. An organic light emitting display, comprising:

a pixel unit having a plurality of pixels arranged therein; and a buffer for amplifying and providing a test signal to the pixel unit to test the pixel unit, the buffer comprising:

an input unit between a first power source and a second power source having a voltage lower than the first power source, and for receiving an input signal to output a first signal;

a first inverter between the first and second power sources, and for receiving the first signal and the input signal to output a second signal obtained by inverting the first signal;

a second inverter between the first and second power sources, and for receiving the second signal and the first signal to output a third signal obtained by inverting the second signal; and an output unit coupled between the first power source and a third power source having a voltage lower than the second power source, and for receiving the third signal and the second signal to output an output signal obtained by inverting the third signal, wherein the input unit comprises first, second and third transistors coupled in series between the first and second power sources, the third transistor comprising a gate directly electrically connected to the second power source.

12. The organic light emitting display as claimed in claim 11, wherein:

the first transistor comprises a source coupled to the first power source, a drain coupled to a first node, and a gate coupled to an input terminal for receiving the input signal;

the second transistor comprises a source coupled to the first node, a drain coupled to a source of the third transistor, and a gate coupled to the second power source; and the third transistor comprises the source coupled to the drain of the second transistor and a drain coupled to the second power source.

13. The organic light emitting display as claimed in claim 12, wherein the first inverter comprises:

a fourth transistor including a source coupled to the first power source, a drain coupled to a second node, and a gate for receiving the first signal; and a fifth transistor including a source coupled to the second node, a drain coupled to the second power source, and a gate for receiving the input signal.

14. The organic light emitting display as claimed in claim 13, wherein the second inverter comprises:

a sixth transistor including a source coupled to the first power source, a drain coupled to a third node, and a gate for receiving the second signal; and a seventh transistor including a source coupled to the third node, a drain coupled to the second power source, and a gate for receiving the first signal.

15. The organic light emitting display as claimed in claim 14, wherein the output unit comprises:

an eighth transistor including a source coupled to the first power source, a drain coupled to an output terminal for outputting the output signal, and a gate for receiving the third signal; and a ninth transistor including a source coupled to the output terminal, a drain coupled to the third power source, and a gate for receiving the second signal.

16. The organic light emitting display as claimed in claim 15, further comprising a capacitor coupled between the output terminal and the gate of the ninth transistor.

17. The organic light emitting display as claimed in claim 11, wherein the first inverter comprises:

a first transistor including a source coupled to the first power source, a drain coupled to a node, and a gate for receiving the first signal; and a second transistor including a source coupled to the node, a drain coupled to the second power source, and a gate for receiving the input signal.

18. The organic light emitting display as claimed in claim 11, wherein the second inverter comprises:

a first transistor including a source coupled to the first power source, a drain coupled to a node, and a gate for receiving the second signal; and a second transistor including a source coupled to the node, a drain coupled to the second power source, and a gate for receiving the first signal.

19. The organic light emitting display as claimed in claim 11, wherein the output unit comprises:

a first transistor including a source coupled to the first power source, a drain coupled to an output terminal for outputting the output signal, and. a gate for receiving the third signal; and a second transistor including a source coupled to the output terminal, a drain coupled to the third power source, and a gate for receiving the second signal.

20. The organic light emitting display as claimed in claim 19, further comprising a capacitor coupled between the output terminal and the gate of the second transistor.

* * * * *

UNITED STATES PATENT AND TRADEMARK OFFICE

CERTIFICATE OF CORRECTION

PATENT NO. : 8,570,309 B2
APPLICATION NO. : 12/418293
DATED : October 29, 2013
INVENTOR(S) : Jin-Tae Jeong It is certified that error appears in the above-identified patent and that said Letters Patent is hereby corrected as shown below:

In the claims:

| | |
|---|---|
| Col. 10, line 16, Claim 19 | Delete "and. a",<br>Insert --and a-- |

Signed and Sealed this
Twentieth Day of January, 2015

Michelle K. Lee

Michelle K. Lee
*Deputy Director of the United States Patent and Trademark Office*